US008113224B2

(12) United States Patent
Yul et al.

(10) Patent No.: US 8,113,224 B2
(45) **Date of Patent: *Feb. 14, 2012**

(54) MOISTURE DIVERSION SYSTEM FOR A COLLAPSIBLE STRUCTURE

(75) Inventors: Lee Pil Yul, Seoul (KR); Yang Wei Dong, Fujian (CN); Anthony Sanford-Schwentke, Scotland (GB)

(73) Assignee: North Pole Limited, Kowloon (HK)

( * ) Notice: Subject to any disclaimer, the term of this patent is extended or adjusted under 35 U.S.C. 154(b) by 0 days.

This patent is subject to a terminal disclaimer.

(21) Appl. No.: 12/765,538

(22) Filed: Apr. 22, 2010

(65) Prior Publication Data

US 2010/0200036 A1 Aug. 12, 2010

Related U.S. Application Data

(63) Continuation of application No. 11/504,233, filed on Aug. 14, 2006, now Pat. No. 7,721,746.

(30) Foreign Application Priority Data

Aug. 25, 2005 (CN) ..... 2005 2 0086591 U
Nov. 2, 2005 (CN) ..... 2005 2 0088599 U

(51) Int. Cl.
*E04H 15/14* (2006.01)

(52) U.S. Cl. ..... 135/93; 135/115; 135/117; 52/63

(58) Field of Classification Search ..... 135/91–94, 135/115, 117, 124, 135, 907; 52/63, 82–83, 52/74, 11–13; 454/367–368
See application file for complete search history.

(56) References Cited

U.S. PATENT DOCUMENTS

| | | | |
|---|---|---|---|
| 1,539,907 | A | 6/1925 | McGill |
| 3,698,409 | A | 10/1972 | Koontz et al. |
| 4,285,355 | A | 8/1981 | Lundblade |
| 4,293,957 | A | 10/1981 | Melarvie |
| 4,519,410 | A | 5/1985 | Kubacki |
| 4,625,468 | A | 12/1986 | Hampel |
| 4,709,718 | A | 12/1987 | Nichols |
| 4,941,499 | A | 7/1990 | Pelsue et al. |
| 5,067,505 | A | 11/1991 | Cantwell et al. |
| 5,678,361 | A | 10/1997 | Bair |
| 5,771,912 | A | 6/1998 | Swetish |
| 6,338,356 | B1 | 1/2002 | Wallenstatter |
| 6,349,506 | B1 | 2/2002 | Pace et al. |
| 6,357,462 | B1 | 3/2002 | Laosunthara et al. |
| 6,463,948 | B2 | 10/2002 | Lee |
| 6,470,901 | B1 | 10/2002 | Scherer |
| 6,474,022 | B1 | 11/2002 | Double et al. |
| 6,681,785 | B2 | 1/2004 | Choi |

(Continued)

FOREIGN PATENT DOCUMENTS

| | | | |
|---|---|---|---|
| DE | 3606278 | A1 | 9/1987 |
| JP | 09049348 | A * | 2/1997 |
| JP | 11293963 | A | 10/1999 |

*Primary Examiner* — Winnie Yip
(74) *Attorney, Agent, or Firm* — Armstrong Teasdale LLP

(57) ABSTRACT

A moisture diversion system is provided for a collapsible structure including a collapsible frame assembly and an outer structure coupled to the collapsible frame assembly. The moisture diversion system includes a guide strip coupled at each of a first edge and an opposing second edge to the outer structure. The guide strip defines a channel between the first edge and the second edge for facilitating diverting moisture from the outer structure.

12 Claims, 4 Drawing Sheets

U.S. PATENT DOCUMENTS

| | | | |
|---|---|---|---|
| 7,222,635 | B2 | 5/2007 | Cantwell |
| 7,308,901 | B2 | 12/2007 | Meyer |
| 2004/0173251 | A1 | 9/2004 | Cantwell |
| 2005/0178417 | A1 | 8/2005 | Holub |
| 2005/0194030 | A1 | 9/2005 | Goldwitz |
| 2008/0163910 | A1 | 7/2008 | Hollinger |

* cited by examiner

MOISTURE DIVERSION SYSTEM FOR A COLLAPSIBLE STRUCTURE

CROSS REFERENCE TO RELATED APPLICATIONS

This application is a continuation of prior U.S. patent application Ser. No. 11/504,233, filed Aug. 14, 2006, now U.S. Pat. No. 7,721,746, which is hereby incorporated by reference in its entirety, which claims the benefit of Chinese Patent Application 200520086591.5 entitled "Non-Water Pocket Tent," filed in the State Intellectual Property Office of China on Aug. 25, 2005, and Chinese Patent Application 200520088599.5 entitled "Improved Non-Water Pocket Tent," filed in the State Intellectual Property Office of China on Nov. 2, 2005, each of which is hereby incorporated by reference in its entirety.

BACKGROUND OF THE INVENTION

This invention relates generally to collapsible structures, such as tents and gazebos, and, more particularly, to a moisture diversion system for a collapsible structure for diverting moisture, such as rain water, from a fabric covering of the collapsible structure and channeling the moisture away from the collapsible structure.

Camping and social activities are becoming increasingly popular. With people's current living standards improving, so are the demands for simplified and user-friendly camping and/or social activity structures. For example, tents are becoming a favored necessity for camping activities. However, during inclement weather, the tent is exposed to harsh environmental conditions. For example, during a rain storm, rain water may collect on the outer fabric structure of the tent and form a puddle of standing rain water, which may cause damage to the tent and/or undesirable leakage through the fabric structure and into the living and/or sleeping area defined within the tent.

BRIEF DESCRIPTION OF THE INVENTION

In one aspect, a moisture diversion system is provided for a collapsible structure including a collapsible frame assembly and an outer structure coupled to the collapsible frame assembly. The moisture diversion system includes a guide strip coupled at each of a first edge and an opposing second edge to the outer structure. The guide strip defines a channel between the first edge and the second edge for facilitating diverting moisture from the outer structure.

In another aspect, a moisture diversion system is provided for a collapsible structure including a collapsible frame assembly and a main structure coupled to the collapsible frame assembly. The main structure is configured to at least partially define an interior space. The moisture diversion system includes an outer cover coupled to the collapsible frame assembly and configured to cover at least a portion of the main structure. A guide strip is sealingly coupled to the outer cover. The guide strip defines a channel for facilitating diverting moisture from the outer cover.

In another aspect, a moisture diversion system is provided for a collapsible structure including a collapsible frame assembly. The moisture diversion system includes an outer cover coupled to the collapsible frame assembly and configured to at least partially define an interior space. The outer cover includes a first panel. A first side edge is coupled to the first panel along a first seam. A first void is at least partially defined within the first panel. A second void is at least partially defined within the first side edge. The second void is in fluid communication with the first void, and collectively the first and second void define a channel for facilitating diverting moisture from the outer cover.

In another aspect, a tent is provided. The tent includes a collapsible frame assembly. A main tent structure is coupled to the collapsible frame assembly and configured to at least partially define an interior space. An outer cover is coupled to the collapsible frame assembly and configured to cover at least a portion of the main tent structure. A moisture diversion system is operatively coupled to the outer cover. The moisture diversion system includes a guide strip sealingly coupled to the outer cover. The guide strip defines a channel for facilitating diverting moisture from the outer cover.

In another aspect, a gazebo is provided. The gazebo includes a collapsible frame assembly. An outer cover is coupled to the collapsible frame assembly and configured to at least partially define an interior space. The outer cover includes a first panel. A first side edge is coupled to the first panel along a first seam. A moisture diversion system includes a first void at least partially defined by the first panel and a second void at least partially defined by the first side edge. The second void is in fluid communication with the first void, and collectively the first void and the second void at least partially define a channel for facilitating diverting moisture from the outer cover.

DETAILED DESCRIPTION OF THE INVENTION

The present invention provides a moisture diversion system for a collapsible structure, such as a tent, a canopy or a gazebo, including a collapsible frame assembly and an outer cover or roof structure coupled to the collapsible frame assembly. In one embodiment, the moisture diversion system includes a guide strip operatively coupled to the outer cover or roof structure. The guide strip defines a channel for facilitating diverting moisture, such as snow, sleet, rain and/or dew, from the outer cover or roof structure. In a particular embodiment, the moisture diversion system includes a mesh cover that is coupled to the guide strip and configured to at least partially cover the channel.

The present invention is described below in reference to its application in connection with and operation of a moisture diversion system for facilitating diverting moisture from the outer cover or roof structure of a collapsible structure, such as a tent, a canopy or a gazebo. However, it will be apparent to those skilled in the art and guided by the teachings herein provided that the invention is likewise applicable to any suitable collapsible and/or permanent structure for facilitating diverting moisture from the outer cover or roof structure.

Figure 2:
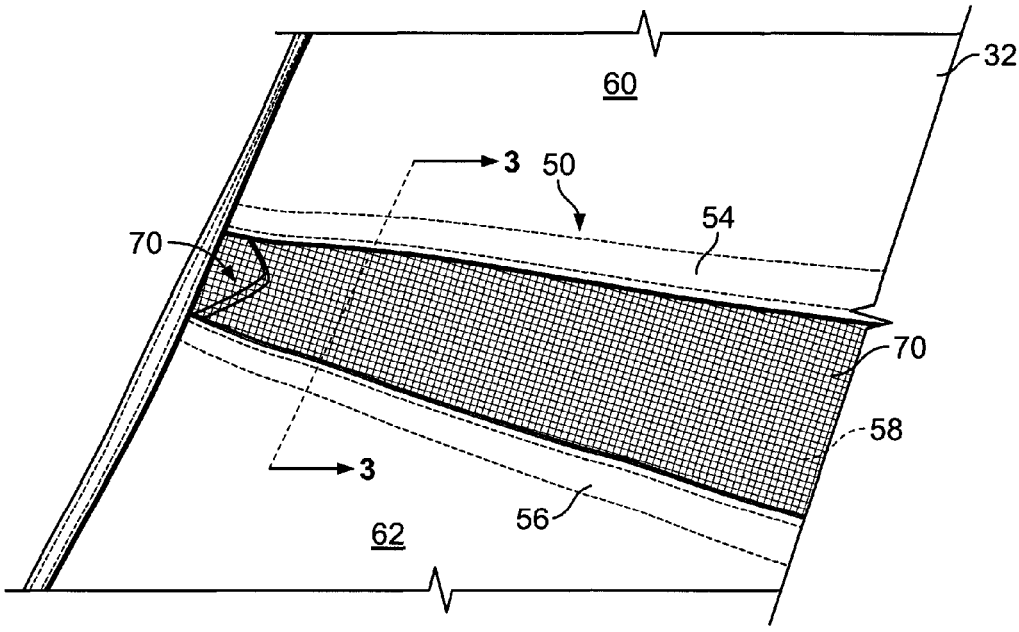
FIG. 2 is a plan view of a portion of an outer cover for the collapsible structure shown in FIG. 1.
Figure 3:
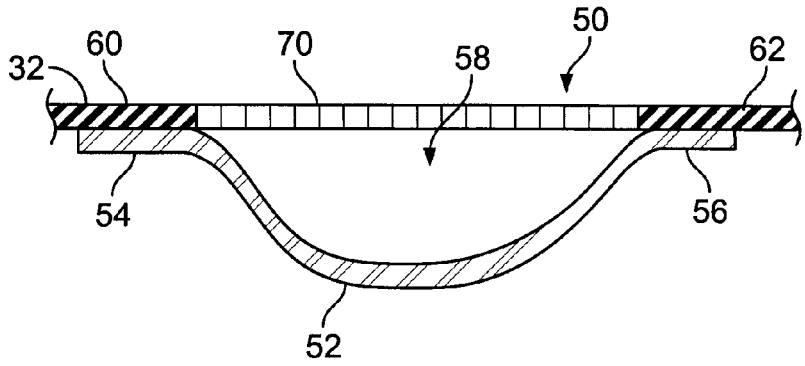
FIG. 3 is a section view of a portion of the outer cover shown in FIG. 2 along sectional line A-A.
Figure 4:
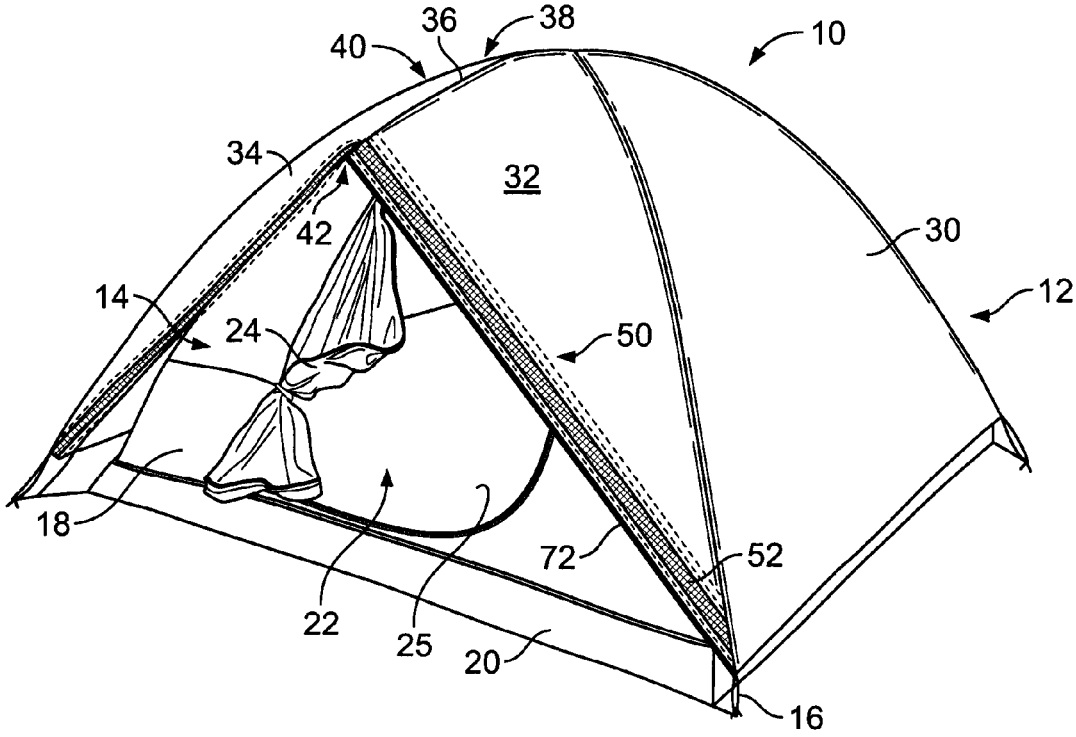
FIG. 4 is a perspective view of an alternative exemplary collapsible structure including an exemplary moisture diversion system.
Figure 5:
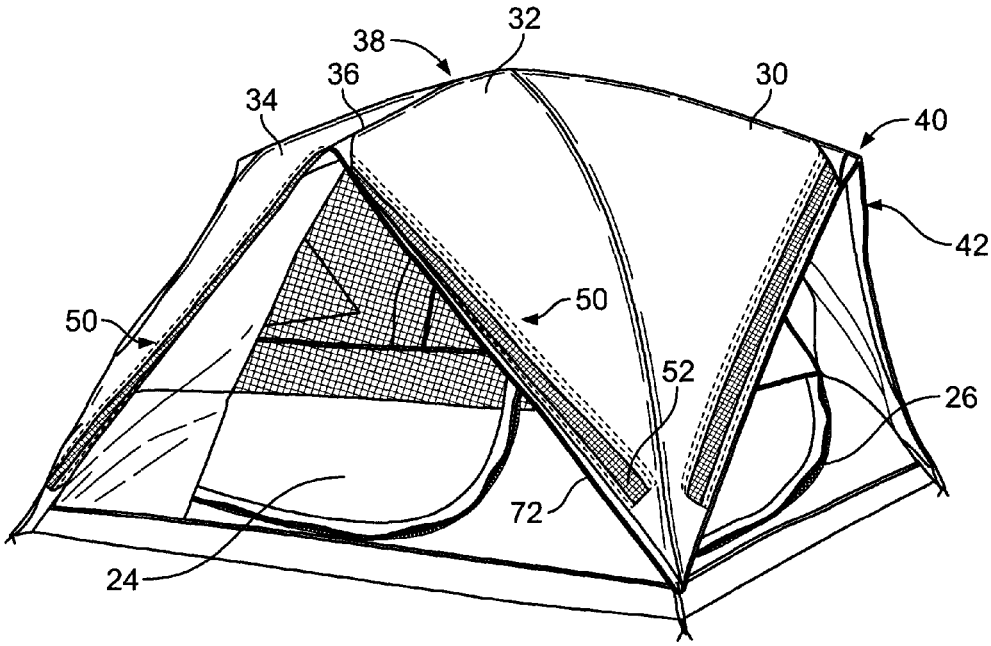
FIG. 5 is a perspective view of an alternative exemplary collapsible structure including an exemplary moisture diversion system.

FIGS. 1-5 show an exemplary collapsible structure 10. In one embodiment, collapsible structure 10 is a tent 12 that includes a main tent structure 14 formed of a suitable fabric material. Tent structure 14 is coupled to a collapsible frame assembly 16 to form a plurality of walls 18. A floor 20 is coupled to each wall 18 to form tent structure 14 and define an interior space 22 therein. Interior space 22 is large enough to comfortably accommodate one or more people. It is apparent to those skilled in the art and guided by the teachings herein provided that tent 12 may include any suitable number of walls having any suitable size and/or shape. In one embodiment, at least one wall 18 forms a door 24 that is configured to provide access to interior space 22 through an opening 25 defined within wall 18, as shown in FIG. 4. Further, in this embodiment tent structure 14 includes at least one window 26, as shown in FIG. 5, formed in at least one wall 18 and configured to provide ventilation within interior space 22.

Collapsible frame assembly 16 includes a plurality of flexible poles fabricated from a suitable flexible material, such as a metal, alloy, composite and/or plastic material. The flexible poles are removably coupled together to form a frame assembly having sufficient strength to shape tent structure 14 and maintain tent structure 14 in an assembled configuration. In one embodiment, the flexible poles are fabricated from a fiberglass material. Such frame assemblies are known in the art and a further detailed description of frame assembly 16 is not required to allow one of ordinary skill in the art guided by the teaching herein provided to practice the present invention.

Figure 1:
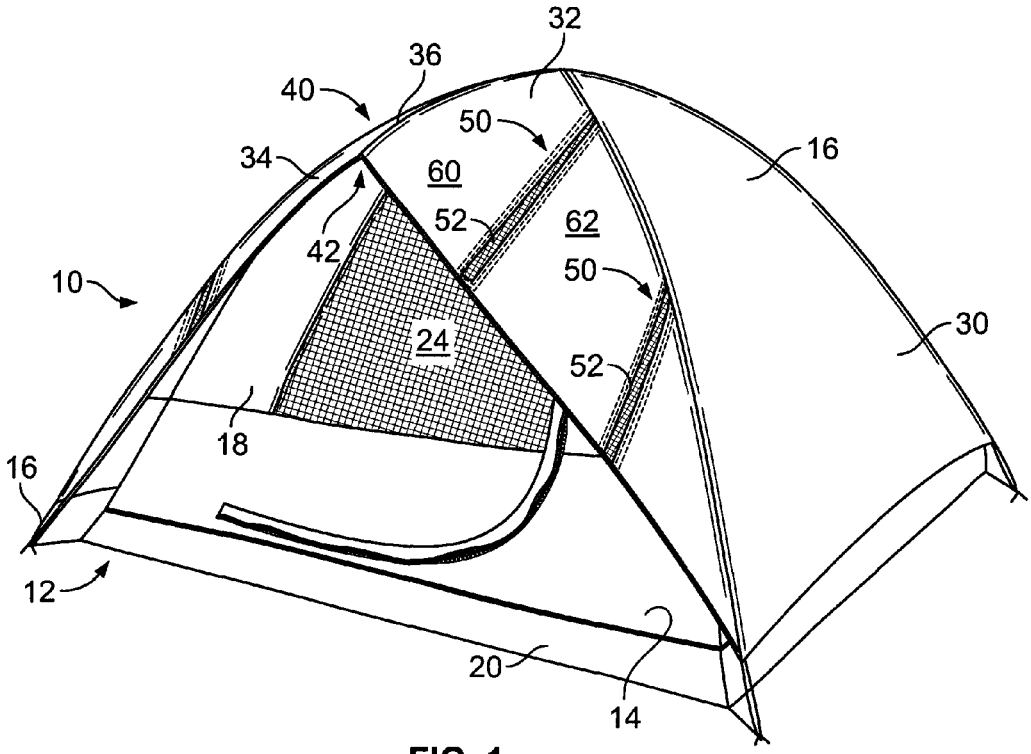
FIG. 1 is a perspective view of an exemplary collapsible structure including an exemplary moisture diversion system.

Referring to FIG. 1, tent 12 includes an outer cover or rain fly 30 coupled to collapsible frame assembly 16 and configured to cover at least a portion of tent structure 14. In one embodiment, outer cover 30 is coupled with respect to tent structure 14 to provide further protection from harsh environmental elements, including rain, sleet and/or snow for example. Outer cover 30 is coupled to collapsible frame assembly 16 using a suitable coupler, such as a guy wire, a strap and/or a clip. Outer cover 30 is fabricated of a suitable fabric material, such as a fabric material similar to the fabric material from which tent structure 14 is fabricated. In one embodiment, a space is defined between outer cover 30 and tent structure 14 for facilitating air circulation through tent 12 to provide ventilation to interior space 22 and/or to prevent or limit moisture collecting on an outer surface of tent structure 14 and/or on outer cover 30. In one embodiment, outer cover 30 includes a first panel 32 and a second panel 34 coupled to first panel 32 along a seam 36, as shown in FIGS. 1, 4 and 5. Seam 36 forms at least a portion of a ridge 38 of outer cover 30 that is supported by frame assembly 16. In a particular embodiment, first panel 32 is substantially similar to second panel 34.

In one embodiment, an awning frame assembly 40 is coupled to or integrated with frame assembly 16. Awning frame assembly 40 is configured to support a portion of outer cover 30 to form an awning 42 above door 24, as shown in FIGS. 1 and 4, and/or an awning 42 above a window 26, as shown in FIG. 5. In this embodiment, awning 42 includes first panel 32 coupled to second panel 34 at seam 36. Awning 42 is supported by awning frame assembly 40 along seam 36 to form ridge 38.

Referring further to FIGS. 1-5, tent 12 includes a moisture diversion system 50 operatively coupled to outer cover 30. In one embodiment, moisture diversion system 50 includes at least one guide strip 52 that is sealingly coupled to outer cover 30. As shown in FIG. 3, guide strip 52 includes a first edge 54 and an opposing second edge 56 that define a channel 58 for facilitating diverting moisture from outer cover 30. In one embodiment, first edge 54 is sealingly coupled to a first portion 60 of first panel 32 and second edge 56 is sealingly coupled to a second portion 62 of first panel 32, as shown in FIG. 3. Channel 58 is defined between first edge 54 and second edge 56. In a particular embodiment, a mesh cover 70, as shown in FIG. 2, is coupled between first edge 54 and second edge 56 to at least partially cover channel 58. Mesh cover 70 is configured to maintain channel 58 in a suitable configuration to direct moisture, such as rain water, away from outer cover 30 and/or prevent debris, such as leaves and/or small twigs, from landing in channel 58 and blocking or disrupting fluid flow through channel 58.

In one embodiment, moisture diversion system 50 includes a plurality of guide strips 52 operatively coupled to outer cover 30, as shown in FIG. 1. In a particular embodiment, each guide strip 52 is substantially parallel to ridge 38. In an alternative embodiment, as shown in FIGS. 4 and 5, first edge 54 or second edge 56 forms a seam edge 72 of outer cover 30.

Figure 6:
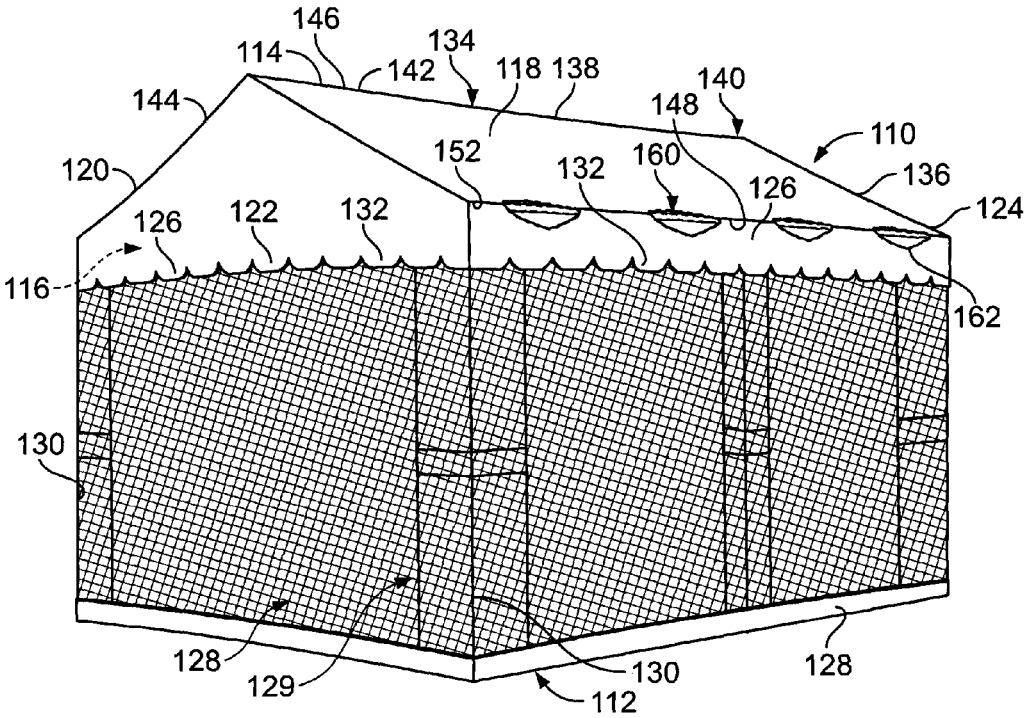
FIG. 6 is a perspective view of an alternative exemplary collapsible structure including an exemplary moisture diversion system.

FIGS. 6-9 show an alternative exemplary collapsible structure 110. Referring to FIG. 6, collapsible structure 110 is a gazebo 112 that includes an outer cover or roof structure 114 formed of a suitable fabric material. Roof structure 114 is coupled to a collapsible frame assembly 116 to form a first roof panel 118, an opposing second roof panel 120, opposing gables 122, 124, and a plurality of side edges 126, as shown in FIG. 6. In one embodiment, gazebo 112 includes a plurality of walls 128 coupled to corresponding side edges 126 and/or collapsible frame assembly 116. In a particular embodiment, walls 128 are removable, if desired. In an assembled configuration as shown in FIG. 6, gazebo 112 defines an interior space 129 therein. Interior space 129 is large enough to comfortably accommodate one or more people. It is apparent to those skilled in the art and guided by the teachings herein provided that gazebo 112 may include any suitable number of side edges 126 and/or walls 128 having any suitable size and/or shape. Further, gazebo 112 may have any suitable frame assembly 116 and corresponding roof structure 114. Gazebo 112 is movable from the assembled configuration, as shown in FIG. 6, to a collapsed or disassembled configuration for facilitating transporting and/or storing gazebo 112.

Referring further to FIG. 6, collapsible frame assembly 116 includes a plurality of posts 130 fabricated of a suitable material, such as a metal, alloy, composite and/or plastic material, sufficiently strong to provide adequate support to gazebo 112. In one embodiment, post 130 is fabricated of a fiberglass material. Each post 130 is coupled to adjacent posts 130 with a corresponding link member assembly 132. Such frame assemblies are known in the art and a further detailed description of frame assembly 116 is not required to allow one of ordinary skill in the art guided by the teaching herein provided to practice the present invention.

Gazebo 112 includes a roof support assembly 134 coupled to frame assembly 116 and configured to support roof structure 114. In one embodiment, a pole or support link assembly 136 is coupled between a corresponding post 130 and a roof support member 138. Roof support member 138 spans a length of gazebo 112 and defines a ridge 140.

As shown in FIG. 6, roof structure 114 includes first panel 118 and opposing second panel 120. A first or top edge 142 of first panel 118 is coupled to a first or top edge 144 of second panel 120 along a ridge seam 146 generally aligned with ridge 140 and supported by roof support assembly 134. First panel 118 is coupled at an opposing second or bottom edge 148 to a corresponding first side edge 126 along a first seam 152 substantially parallel to ridge seam 146. Similarly, second panel 120 is coupled at an opposing second or bottom edge to a corresponding second side edge along a second seam substantially parallel to ridge seam 146.

Figure 7:
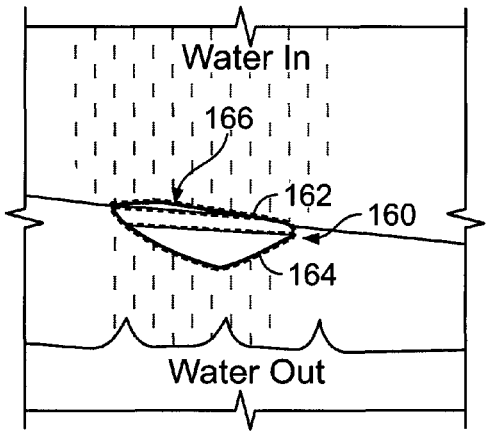
FIG. 7 is plan view of a portion of the collapsible structure shown in FIG. 6.
Figure 8:
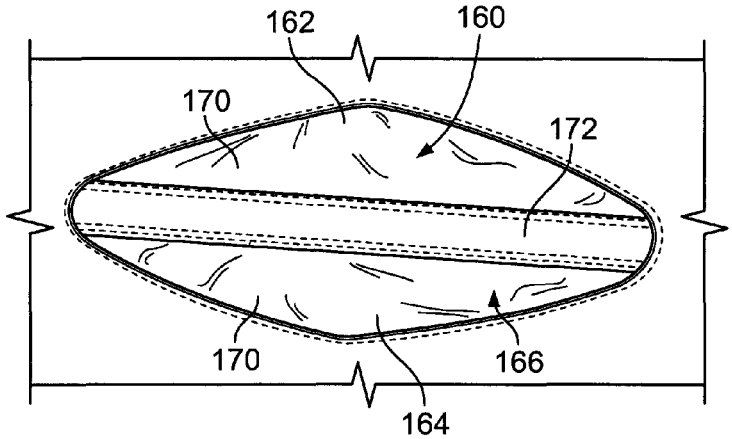
FIG. 8 is plan view of an outer surface of the collapsible structure shown in FIG. 6.
Figure 9:
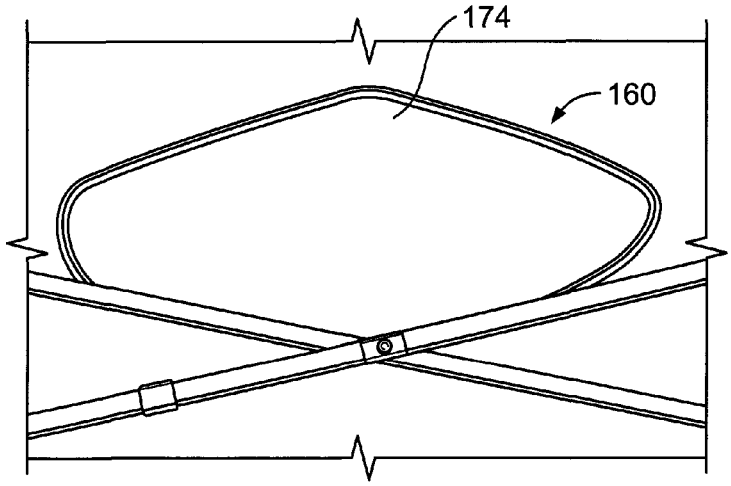
FIG. 9 is plan view of an inner surface of the collapsible structure shown in FIG. 6.

Referring further to FIGS. 7-9, gazebo 112 includes a moisture diversion system 160 operatively coupled to roof structure 114. In one embodiment, moisture diversion system 160 includes at least one void 162 at least partially defined by first panel 118 and at least one void 164 at least partially defined by corresponding first side edge 126. Second void 164 is in fluid communication with first void 162. Collectively, first void 162 and second void 164 define a channel 166 for facilitating diverting moisture from roof structure 114. In one embodiment, a mesh cover 170 is coupled to first panel 118 and first side edge 126 and configured to cover channel 166. Mesh cover 170 is configured to maintain channel 166 in a suitable configuration to direct moisture, such as rain water, away from roof structure 114 and/or prevent debris, such as leaves and/or small twigs, from landing in channel 166 and blocking or disrupting fluid flow through channel 166.

As shown in FIG. 8, in one embodiment a strap 172 extends along at least a portion of first seam 152 and defines a portion of first void 162 and a portion of second void 164. Strap 172 is configured to at least partially support channel 166 and maintain channel 166, as well as moisture diversion system 160, properly configured with respect to roof structure 114. In one embodiment, a back panel 174 is coupled to an interior surface of first panel 118 and first side edge 126, as shown in FIG. 9. Back panel 174 is configured to at least partially define channel 166. Back panel 172 is fabricated of a suitable moisture-resistant or moisture-impermeable material to limit or prevent moisture leakage and/or seepage through roof structure 114 into interior space 129 of gazebo 112.

It is apparent to those skilled in the art and guided by the teachings herein provided that moisture diversion system 160 may include any suitable number of channels 166 defined along first seam 152 to prevent or limit accumulation of moisture, such as snow, sleet, rain and/or dew on roof structure 114 and/or for facilitating diverting moisture from roof structure 114 to prevent collection of moisture thereon, which may result in damage to roof structure 114 and/or the development of leaks through roof structure 114. Further, opposing second panel 120 of roof structure 114 is coupled to a side edge similar to side edge 126 along a second seam substantially parallel to ridge seam 146. In this embodiment, moisture diversion system 160 includes at least one first void at least partially defined by second panel 120 and at least one second void at least partially defined by the second side edge. Each second void is in fluid communication with a corresponding first void and, collectively, the first void and corresponding second void define a channel for facilitating diverting moisture from said outer cover. It is apparent to those skilled in the art and guided by the teachings herein provided that gazebo 112 may have any suitable roof support assembly 134 and corresponding roof structure 114.

The above-described system facilitates diverting moisture, such as rain water, from an outer cover of a collapsible structure, such as a tent or a gazebo. More specifically, the system channels rain water from the outer cover to prevent or limit an undesirable collection of rain water on the outer cover, which may result in damage to the collapsible structure and/or leakage through the outer cover and into the interior space of the collapsible structure.

Exemplary embodiments of a system for facilitating diverting moisture, such as rain water, from an outer cover of a collapsible structure is described above in detail. The system is not limited to the specific embodiments described herein, but rather, components of the system may be utilized independently and separately from other components described herein. Further, the described system components can also be defined in, or used in combination with, other systems and/or apparatus, and are not limited to practice with only the system as described herein.

While the invention has been described in terms of various specific embodiments, those skilled in the art will recognize that the invention can be practiced with modification within the spirit and scope of the claims.

What is claimed is:

1. A moisture diversion system comprising:

a collapsible frame assembly;

a collapsible structure coupled to said collapsible frame assembly; and an outer cover coupled to the collapsible frame assembly to cover at least a portion of the collapsible frame assembly, said outer cover defining a surface and comprising a first panel and a second panel coupled to said first panel along a seam;

a first guide strip comprising a first edge and an opposing second edge each coupled to said outer cover, said first guide strip defining a channel substantially below the surface and between said first edge and said second edge to facilitate diverting moisture from the collapsible structure, said first edge of said first guide strip sealingly coupled to a first portion of said first panel and said second edge of said first guide strip sealingly coupled to a second portion of said first panel; and a mesh cover coupled between said first edge and said second edge of said first guide strip to at least partially cover said channel.

2. A moisture diversion system in accordance with claim 1 further comprising a second guide strip comprising a first edge and an opposing second edge each coupled to said outer cover, said second guide strip defining a channel between said first edge and said second edge to facilitate diverting moisture from the collapsible structure, said first edge of said second guide strip sealingly coupled to a first portion of said second panel and said second edge of said second guide strip sealingly coupled to a second portion of said second panel.

3. A moisture diversion system in accordance with claim 1 wherein one of said first edge and said second edge of said first guide strip forms a seam edge of said outer cover.

4. A moisture diversion system in accordance with claim 1 wherein said seam forms a ridge of said outer cover to be supported by the collapsible frame assembly, and at least one of said first edge and said second edge of said first guide strip is substantially parallel to said ridge.

5. A moisture diversion system in accordance with claim 1 wherein said seam forms a ridge of said outer cover to be supported by the collapsible frame assembly, and said channel is substantially parallel to said ridge.

6. A moisture diversion system in accordance with claim 1 wherein said first guide strip comprises a moisture-resistant material.

7. A moisture diversion system for a collapsible structure including a main structure configured to at least partially define an interior space, said moisture diversion system comprising:

a collapsible frame assembly positionable on a ground;

an outer cover coupled to the collapsible frame assembly to cover at least a portion of the main structure such that said outer cover has a surface that is not parallel to the ground;

a first guide strip comprising a first edge and an opposing second edge each sealingly coupled to said outer cover, said first guide strip defining a first channel substantially below the surface and between said first edge and said second edge to facilitate diverting moisture from the collapsible structure, said first edge of said first guide strip sealingly coupled to a first portion of said outer cover and said second edge of said first guide strip sealingly coupled to a second portion of said outer cover;

a second guide strip comprising a first edge and an opposing second edge each sealingly coupled to said outer cover, said second guide strip defining a second channel substantially below the surface and between said first edge and said second edge to facilitate diverting moisture from the collapsible structure, said first edge of said second guide strip sealingly coupled to a third portion of said outer cover and said second edge of said second guide strip sealingly coupled to a fourth portion of said outer cover; and a mesh cover coupled between said first edge and said second edge of each of said first guide strip and said second guide strip to at least partially cover said channel defined by each of said first guide strip and said second guide strip.

8. A moisture diversion system in accordance with claim 7 wherein one of said first edge and said second edge of said first guide strip forms a seam edge of said outer cover.

9. A moisture diversion system in accordance with claim 7 wherein at least one of said first edge and said second edge of said first guide strip is substantially parallel to a ridge formed at a seam of said outer cover.

10. A tent comprising:

a collapsible frame assembly positionable on a ground; and a moisture diversion system comprising:

an outer cover coupled to said collapsible frame assembly to cover at least a portion of said collapsible frame assembly such that said outer cover has a surface that is not parallel to the ground, said outer cover comprising a first panel and a second panel coupled to said first panel along a seam;

a first guide strip comprising a first edge and an opposing second edge each coupled to said outer cover, said first guide strip defining a channel substantially below the surface and between said first edge and said second edge to facilitate diverting moisture from the collapsible structure, said first edge of said first guide strip sealingly coupled to a first portion of said first panel and said second edge of said first guide strip sealingly coupled to a second portion of said first panel, said first guide strip extending substantially an entire length of said first panel; and a second guide strip comprising a first edge and an opposing second edge each coupled to said outer cover, said second guide strip defining a channel substantially below the surface and between said first edge and said second edge to facilitate diverting moisture from the collapsible structure, said first edge of said second guide strip sealingly coupled to a first portion of said second panel and said second edge of said second guide strip sealingly coupled to a second portion of said second panel, said second guide strip extending substantially an entire length of said second panel; and a mesh cover coupled between said first edge and said second edge of said first guide strip and said second guide strip to at least partially cover said channel defined by each of said first guide strip and said second guide strip.

11. A tent in accordance with claim 10 further comprising an awning frame assembly coupled to said collapsible frame assembly and configured to support a portion of said outer cover to form an awning.

12. A tent in accordance with claim 11 wherein said seam forms a ridge of said awning, said first edge of said first guide strip sealingly coupled to a first portion of said first panel and said opposing second edge of said first guide strip sealingly coupled to a second portion of said first panel, and said first channel is defined between said first edge and said second edge of said first guide strip.

* * * * *